US010926982B2

(12) United States Patent
Lindberg

(10) Patent No.: US 10,926,982 B2
(45) Date of Patent: Feb. 23, 2021

(54) HOISTING ARRANGEMENT OF ROPE HOIST

(71) Applicant: KONECRANES GLOBAL CORPORATION, Hyvinkää (FI)

(72) Inventor: Teppo Lindberg, Nuppulinna (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 16/309,715

(22) PCT Filed: Jun. 15, 2017

(86) PCT No.: PCT/FI2017/050447
§ 371 (c)(1),
(2) Date: Dec. 13, 2018

(87) PCT Pub. No.: WO2017/216425
PCT Pub. Date: Dec. 21, 2017

(65) Prior Publication Data

US 2019/0135595 A1 May 9, 2019

(30) Foreign Application Priority Data

Jun. 16, 2016 (FI) ..... 20165499

(51) Int. Cl.
*B66D 3/08* (2006.01)
*B66C 21/00* (2006.01)
(Continued)

(52) U.S. Cl.
CPC ..... *B66D 3/08* (2013.01); *B66C 11/16* (2013.01); *B66C 21/00* (2013.01); *B66D 1/30* (2013.01); *B66D 1/36* (2013.01); *B66C 13/00* (2013.01)

(58) Field of Classification Search
CPC ..... B66C 11/16; B66C 21/00; B66D 1/30; B66D 1/36; B66D 3/08
See application file for complete search history.

(56) References Cited

U.S. PATENT DOCUMENTS 1,670,993 A * 5/1928 Smith ..... B66D 1/36 242/615.3
2,420,050 A * 5/1947 Maude ..... B66D 1/36 242/602.2
(Continued)

FOREIGN PATENT DOCUMENTS

CN 101811648 A 8/2010
DE 256 500 A1 5/1988
(Continued)

OTHER PUBLICATIONS

International Preliminary Report on Patentability (PCT/IPEA/409) issued in PCT/FI2017/050447, completed on Oct. 1, 2018.
(Continued)

*Primary Examiner* — Emmanuel M Marcelo
(74) *Attorney, Agent, or Firm* — Birch, Stewart, Kolasch & Birch, LLP

(57) ABSTRACT

A hoisting arrangement of a rope hoist includes a hoisting rope, a rope drum with one rope groove for the hoisting rope, and a hoisting member for hoisting a load. The hoisting member includes a rope pulley arrangement for the hoisting rope. The hoisting rope is routed from the rope drum via at least the hoisting member's rope pulley arrangement to a fixed attachment point on the rope hoist. The rope drum is tilted in relation to the horizontal plane in a manner where the first end of the rope drum, towards which the hoisting rope is wound in the hoisting member's upper position, is higher than the rope drum's second end, towards which the hoisting rope is unwound in the hoisting member's lower position.

7 Claims, 7 Drawing Sheets

Figure 1:
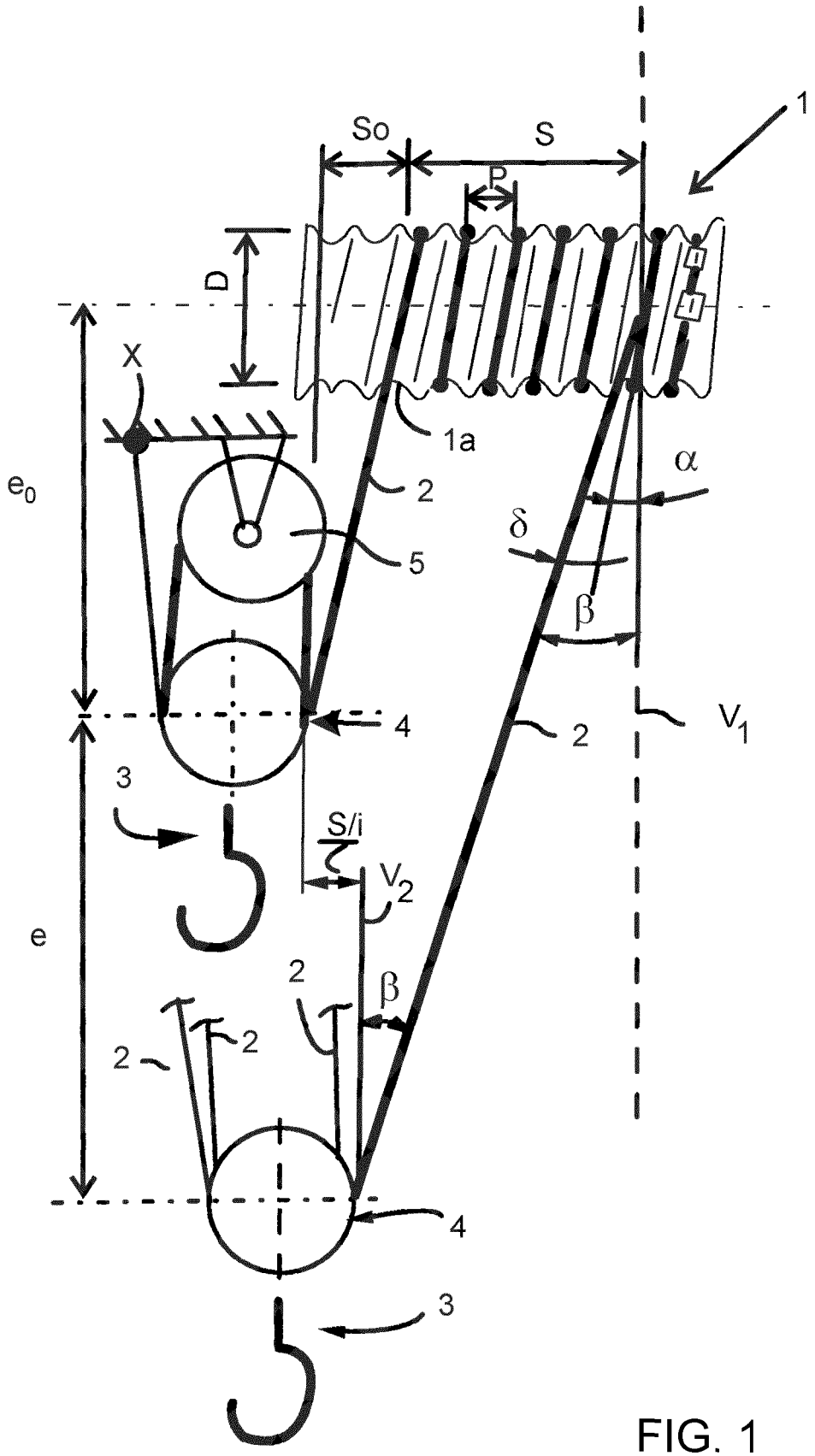

(51) Int. Cl.

| | |
|---|---|
| ***B66D 1/30*** | (2006.01) |
| ***B66C 11/16*** | (2006.01) |
| ***B66D 1/36*** | (2006.01) |
| *B66C 13/00* | (2006.01) |

(56) References Cited

U.S. PATENT DOCUMENTS

| | | | | |
|---|---|---|---|---|
| 2,735,554 | A * | 2/1956 | Ober | B66D 1/36 212/336 |
| 3,690,409 | A * | 9/1972 | Brauss | B66D 1/14 182/142 |
| 4,002,321 | A * | 1/1977 | Shaw | B66D 1/365 254/285 |
| 7,753,345 | B2 * | 7/2010 | Arzberger | B66D 1/365 254/329 |
| 2015/0008381 | A1 * | 1/2015 | Hausladen | B66D 1/30 254/288 |
| 2016/0340160 | A1 * | 11/2016 | Neves | B66D 3/006 |

FOREIGN PATENT DOCUMENTS

| | | | |
|---|---|---|---|
| EP | 0 943 578 | A2 | 9/1999 |
| FR | 2 278 619 | A1 | 2/1976 |
| FR | 2 568 559 | A1 | 2/1986 |
| JP | 62-180897 | A | 8/1987 |
| JP | 6-1388 | U | 1/1994 |
| JP | 11-263591 | A | 9/1999 |
| PT | 106802 | A | 8/2014 |
| RU | 164558 | U1 | 9/2016 |

OTHER PUBLICATIONS

International Search Report (PCT/ISA/210) issued in PCT/FI2017/050447, dated Aug. 30, 2017.

Written Opinion (PCT/ISA/237) issued in PCT/FI2017/050447, dated Aug. 30, 2017.

Extended European Search Report for European Application No. 17812814.6, dated Jan. 20, 2020.

Japanese Office Action for corresponding Japanese Application No. 2018-585842, dated Nov. 5, 2019, with English translation.

Russian Office Action and Search Report for Russian Application No. 2018147155/12(078811), dated Sep. 19, 2019, with English translation.

Chinese Office Action and Search Report for Chinese Application No. 201780037036.9, dated May 9, 2020, with an English translation.

Japanese Office Action for Japanese Application No. 2018-565842, dated Sep. 7, 2020, with English translation.

* cited by examiner

HOISTING ARRANGEMENT OF ROPE HOIST

BACKGROUND OF THE INVENTION

The invention relates to the hoisting arrangement of a rope hoist that comprises the hoisting rope, rope drum with one rope groove for the hoisting rope, and a hoisting member for hoisting a load, which hoisting member comprises a rope pulley arrangement for the hoisting rope, where the hoisting rope is routed from the rope drum via at least the hoisting member's rope pulley arrangement to a fixed attachment point on the rope hoist.

Typically, such a hoisting arrangement of rope hoist can be found in the trolley of a bridge crane that has been arranged to move along a horizontal main support arrangement, for example. The design basis for such equipment has been set forth in the FEM standard (Federation Europeenne de la Manutention, 1.001, booklet 4), among others.

In such an arrangement, an angle is created between the rope groove on the rope drum and the exit direction of the hoisting rope, as the rope drum is "emptied" when the hoisting rope is routed away from it and the release point of the hoisting rope from the rope drum moves outward from the vertical axis of the hoisting member while the hoisting member simultaneously moves downward. The angle is chosen to be small (approximately 0 degrees) in a situation where the hoisting member is at its upper position. When the hoisting member is lowered, the angle increases according to the rope ratio and the diameter of the drum, as the pitch of the rope groove is also taken into account. The above angle between the hoisting rope and the rope groove of the rope drum, also known as the fleet angle, is detrimental if it becomes too large, as this will damage the hoisting rope and rope groove. For this reason, standards limit this angle to less than 2.5 degrees for non-twisting hoisting ropes and less than 4 degrees for hoisting ropes that allow twisting. Even smaller angles will have a negative effect on the service life of the hoisting rope when compared to a situation where this angle has no effect.

In practice, in order to limit the effect of the fleet angle, the diameter of the rope drum (which will naturally affect the rise of the rope groove) must be large enough while taking into account the selected rope ratio. The diameter of the rope drum directly affects the secondary moment on the rope hoist gear and is therefore a substantial cost factor.

When using twisting hoisting ropes that require a fleet angle below 4 degrees, the guidance in the above standard allows for choosing the following ratios of D/d for the diameters of the rope drum and hoisting rope in minimum class M4: above 16 for 1×4 roping, above 20 for 1×6 roping and above 30 for 1×8 roping. When using non-twisting hoisting ropes, which require a fleet angle below 2.5 degrees, the selected diameter ratio D/d for the rope drum and hoisting rope is above 18 for 1×4 roping and above 32 for 1×6 roping.

In the EN standard EN13001-2-2, the detrimental effects of the fleet angle start at above 0.5 degrees; thus, its effects are observed by means of a coefficient that, in practice, starts to decrease from a value of 1.

Due to the problems described above, the fleet angle on a non-twisting hoisting rope is limited to 0-2.5 degrees and the fleet angle on a twisting hoisting rope is limited to 0-4 degrees, which substantially limits the length of the rope drum (a suitable selection of the rope drum diameter and length) as well as the ratio between the diameters of the rope drum and hoisting rope in hoisting arrangements where there are several up-down pitches of a single hoisting rope (more than four i.e. more than 1×4).

SUMMARY OF THE INVENTION

The object of the invention is to solve the problem described above related to the rope drum and the hoisting rope exiting it. The object is achieved by means of an arrangement pursuant to the invention, which is characterised in that the rope drum has been tilted in relation to the horizontal plane in a manner where the first end of the rope drum, towards which the hoisting rope is wound in the hoisting member's upper position, is higher than the rope drum's other end, towards which the hoisting rope is unwound in the hoisting member's lower position.

In other words, simultaneously, the rope drum end that is closer to the hoisting member's vertical line will generally be higher than the end that is further from the vertical line, unless the drum in question is very short.

The magnitude of the tilting depends on all the factors that affect hoisting geometry, but the rope ratio and the diameter of the rope drum have the largest effect on it. A beneficial tilting angle may be 1-4 degrees, for example. In each implementation type, the beneficial tilting angle is the maximum limit value at the lowest position of the hoisting member. This will completely or almost completely compensate for the change in the rope angle.

Typically, the hoisting rope is routed from the rope drum to a fixed attachment point (on the trolley) via the hoisting member's rope pulley arrangement and at least one sheave placed higher up (such as in the frame of the trolley).

Prior art considers the horizontal position of the rope drum to be a self-evident fact, and the idea of changing its position in the manner described in the invention has not previously been adopted as one of the key design criteria.

The solution pursuant to the invention achieves several substantial benefits, as the rope drum's fleet angle may be reduced to a non-detrimental level (close to or approximately 0 degrees). The service life of the hoisting rope is increased. The rope groove on the rope drum will not wear down. The twisting of the hoisting rope as the rope hits the edge of the rope groove is eliminated, which removes the risk of the hoisting rope being damaged due to this reason. There are more options available for the selection of the hoisting rope (twisting/non-twisting) and more inexpensive hoisting ropes may be used. More up-down pitches may also be created in the hoisting rope without reducing the service life of the hoisting rope and rope drum. Selecting the diameter of the rope drum is made easier. The D/d ratio between the diameters of the rope drum and the hoisting rope may be reduced, i.e. a smaller rope drum diameter may be selected; furthermore, a smaller hoisting gear may be selected since the secondary moment is smaller. All of these have a reducing effect on the cost level. The rope ratio may be increased with the same rope drum diameter, which in turn increases the hoisted payload while the diameter of the hoisting rope may be kept as is. In the case of serial manufacturing, the number of combinations available from the same components will increase, which in turn increases cost-efficiency.

The relatively complex and expensive rope guide that routes the hoisting rope to the rope drum may in some cases not be required, as the hoisting rope is naturally routed correctly.

LIST OF FIGURES

Figure 2:
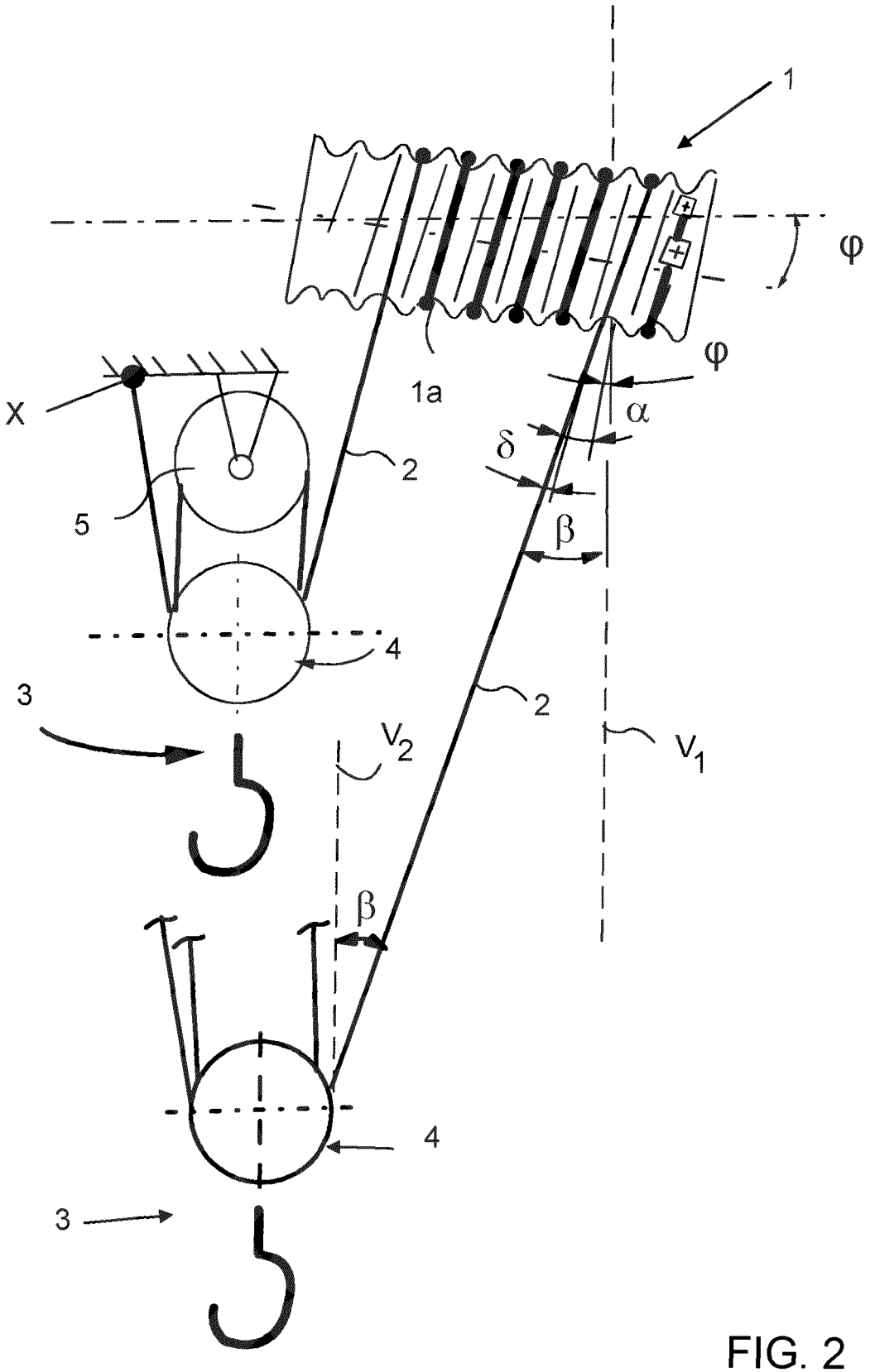
Figure 3:
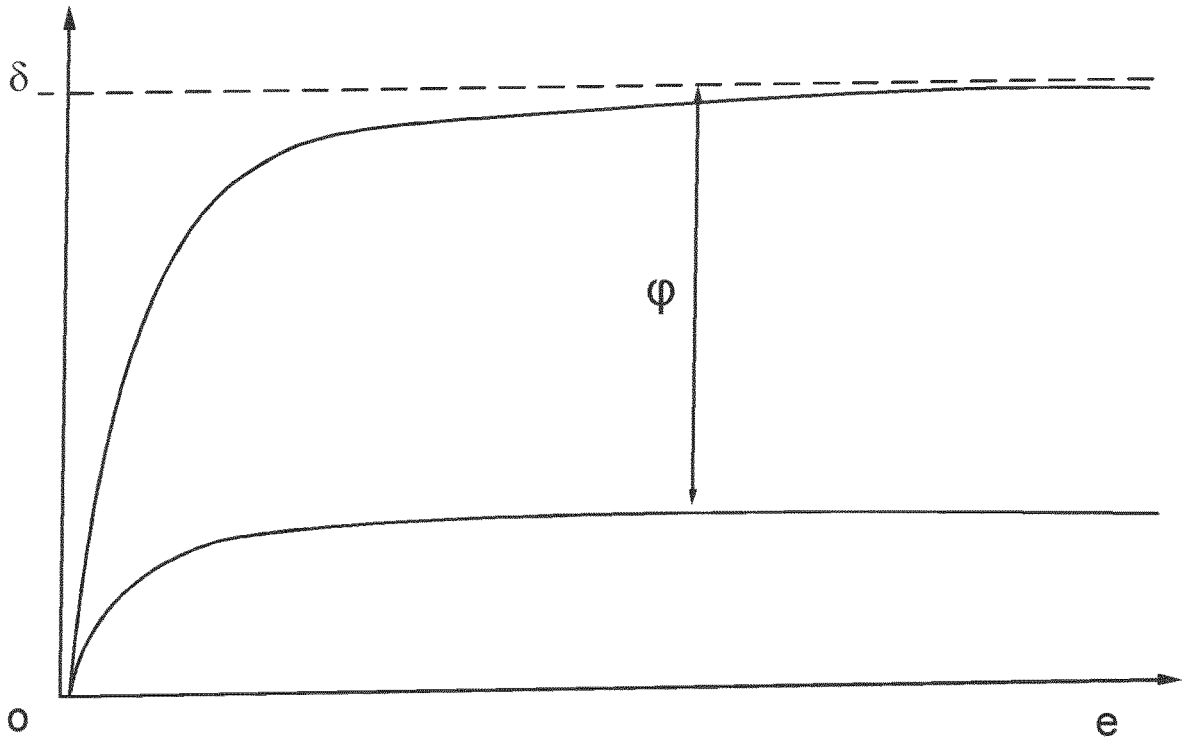

The invention will now be explained in more detail with reference to the accompanying drawings, in which FIG. 1 presents a hoisting arrangement where the rope drum is placed horizontally;

FIG. 2 presents a hoisting arrangement pursuant to FIG. 1, however, the rope drum has been tilted in accordance with the invention;

FIG. 3 presents the effects of the tilting pursuant to the invention on the fleet angle; and FIGS. 4-7 present different implementations of hoist roping with four hoisting ropes in the order pursuant to the invention.

DETAILED DESCRIPTION OF THE INVENTION

With reference to FIG. 1, it shows a hoisting arrangement of rope hoist (for example, in a bridge crane trolley that is not shown) that comprises the rope drum 1 for the hoisting rope 2 and the hoisting member 3 for hoisting the load (not shown). Hoisting member 3 has pulley arrangement 4 for hoisting rope 2. Correspondingly, a higher part of the rope hoist's fixed section, such as its frame, has sheave 5 for hoisting rope 2. Hoisting rope 2 is routed from rope groove 1*a* on rope drum 1 to the fixed attachment point X on the rope hoist via rope pulley arrangement 4 for hoisting member 3 and sheave 5. This uses the single hoisting rope 2 to form a four-rope or 1×4 hoisting rope arrangement pursuant to the Figure that comprises four pitches in the up-down directions. When hoisting member 3 is lowered, hoisting member 3 moves to the side by distance S/i. Rope drum 1 is in the horizontal position. Hoisting rope 2 is on rope drum 1 in one layer.

FIG. 1 shows the following symbols:

S=horizontal transfer of hoisting rope 2 on rope drum 1, when hoisting member 3 has moved from the position shown at the top of the Figure to the position shown at the bottom of the same Figure $S_0$=measurement of the horizontal position of hoisting rope 2 when hoisting member 3 is in the top position e=hoisting height $e_0$=measurement of the vertical position of hoisting member 3 when hoisting member 3 is in the top position i=rope ratio p=pitch of rope groove 1*a*

D=(effective) diameter of rope groove 1*a* d=diameter of hoisting rope 2

π=constant

δ=fleet angle (variable angle between hoisting rope 2 and rope groove 1*a*)

β=angle of hoisting rope 2 relative to vertical planes $V_1$ and $V_2$ $V_1$ and $V_2$=vertical planes α=angle corresponding to the pitch of rope groove 1*a*

In this case, $$S=(e*i*p)/(\pi*D)$$

$$\tan\beta=(S+S_0-S/i)/(e+e_0)$$

$$\tan\alpha=p/\pi*D$$

$$\delta=\beta-\alpha$$

Furthermore, the marking 1×4 may be used in connection with rope ratio i and roping; this means that 4 pitches in the up-down direction have been created using a single hoisting rope 2. In this case, rope ratio i equals 4.

When, following this, rope drum 1, onto which hoisting rope 2 has been wound in a single layer, has been tilted in relation to the horizontal plane pursuant to FIG. 2 and the invention in a manner where the first end of rope drum 1, towards which hoisting rope 2 is wound in the upper position of hoisting member 3, is higher than the other end of rope drum 1, towards which hoisting rope 2 is unwound in the lower position of hoisting member 3 (in this example, it can also be stated that the end of rope drum 1 that is closer to the vertical line of hoisting member 3 is higher than the end that is further away from this vertical line), the reduced fleet angle δ may be calculated from the formula $$\delta=\beta-\alpha-\varphi,$$

where

φ=is the stated tilting angle for the rope drum.

The benefit of the tilting regarding the fleet angle is especially evident in FIG. 3, which presents the fleet angle δ as a function of hoisting height e. The upper curve describes a typical change in fleet angle δ with an non-tilted rope drum 1, while the lower curve describes it for the tilted rope drum 1. The benefit of a tilted rope drum 1 in the reduction of fleet angle δ is obvious already at relatively low hoisting heights. FIG. 3 presents the lower curve as a graph where it clearly differs from the horizontal axis. In practice, the benefit from the tilting may be so high that the lower curve runs very close to the horizontal axis, but here, it is clearly separated in order to improve readability.

Figure 4:
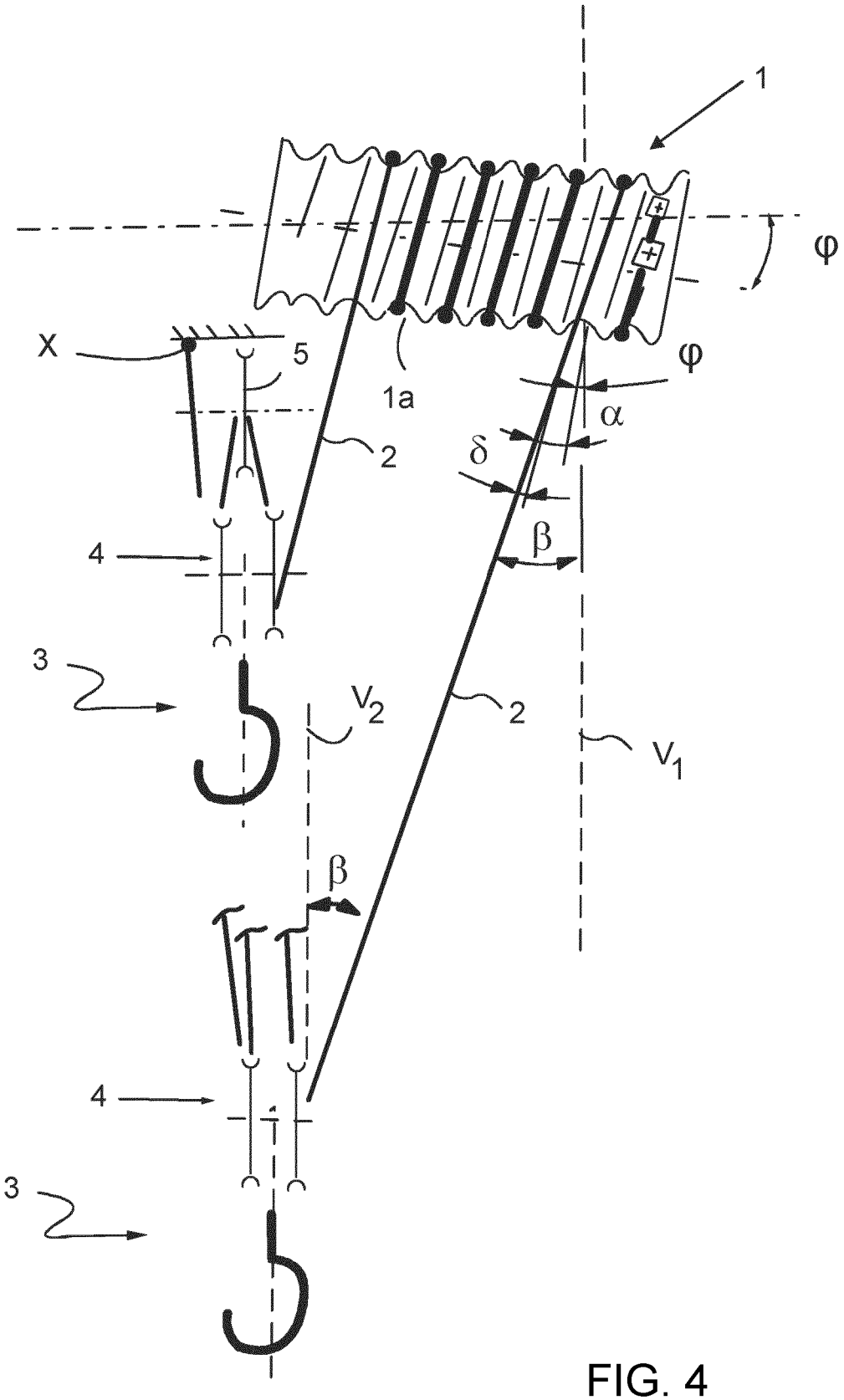

FIG. 4 presents a hoisting arrangement pursuant to the invention that contains a tilted hoisting drum 1; this differs from the hoisting arrangement in FIG. 2 in that hoisting member 3's rope pulley arrangement 4 and sheave 5 are rotated by 90 degrees about the vertical axis.

Figure 5:
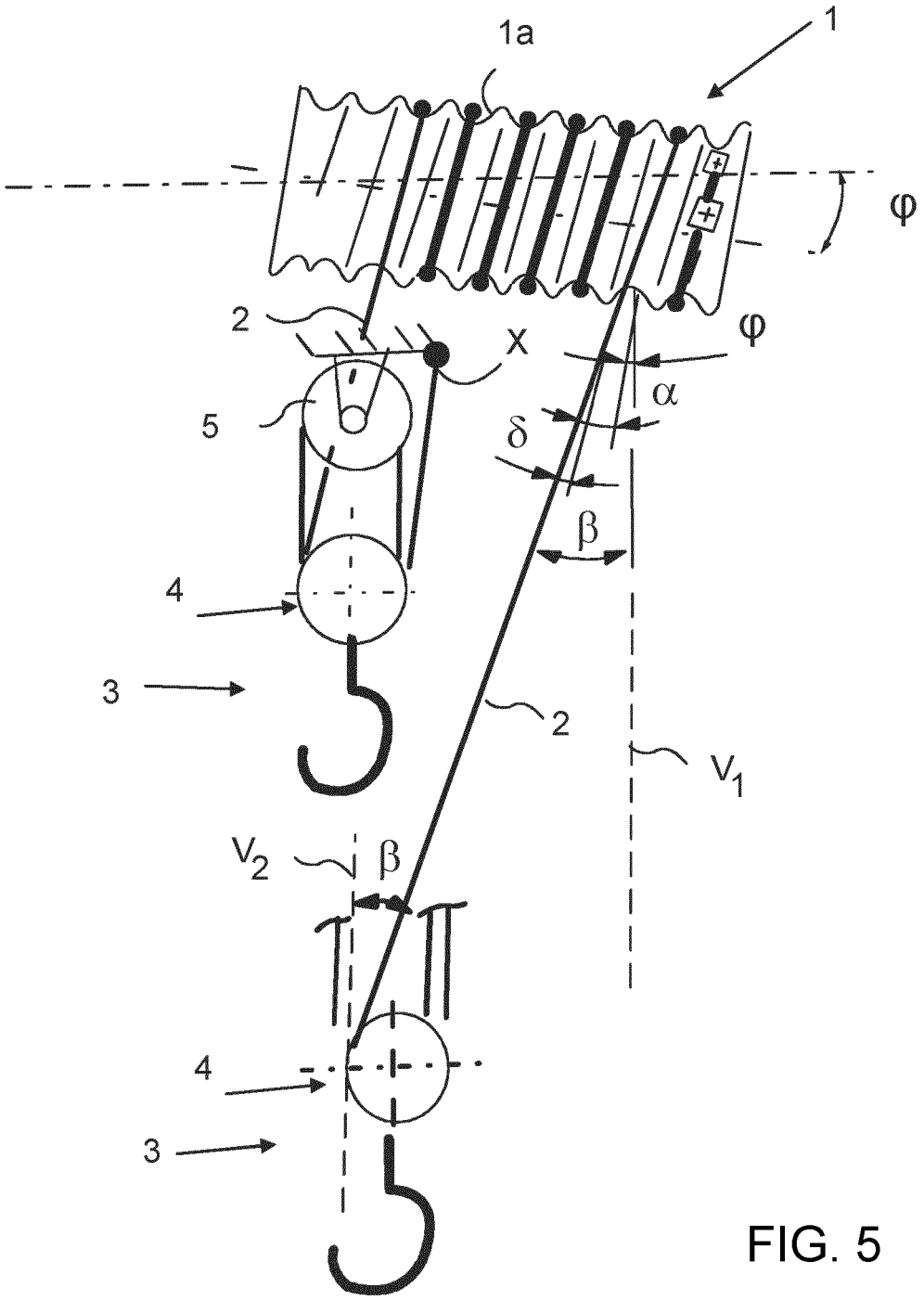

FIG. 5 presents a hoisting arrangement pursuant to the invention that contains a tilted hoisting drum 1; this differs from the hoisting arrangement in FIG. 2 in that hoisting rope 2 is routed to rope drum 1 on the other side of rope pulley arrangement 4 (the upper side of rope drum 1). Furthermore, attachment point X for hoisting rope 2 is on the other side of sheave 5.

Figure 6:
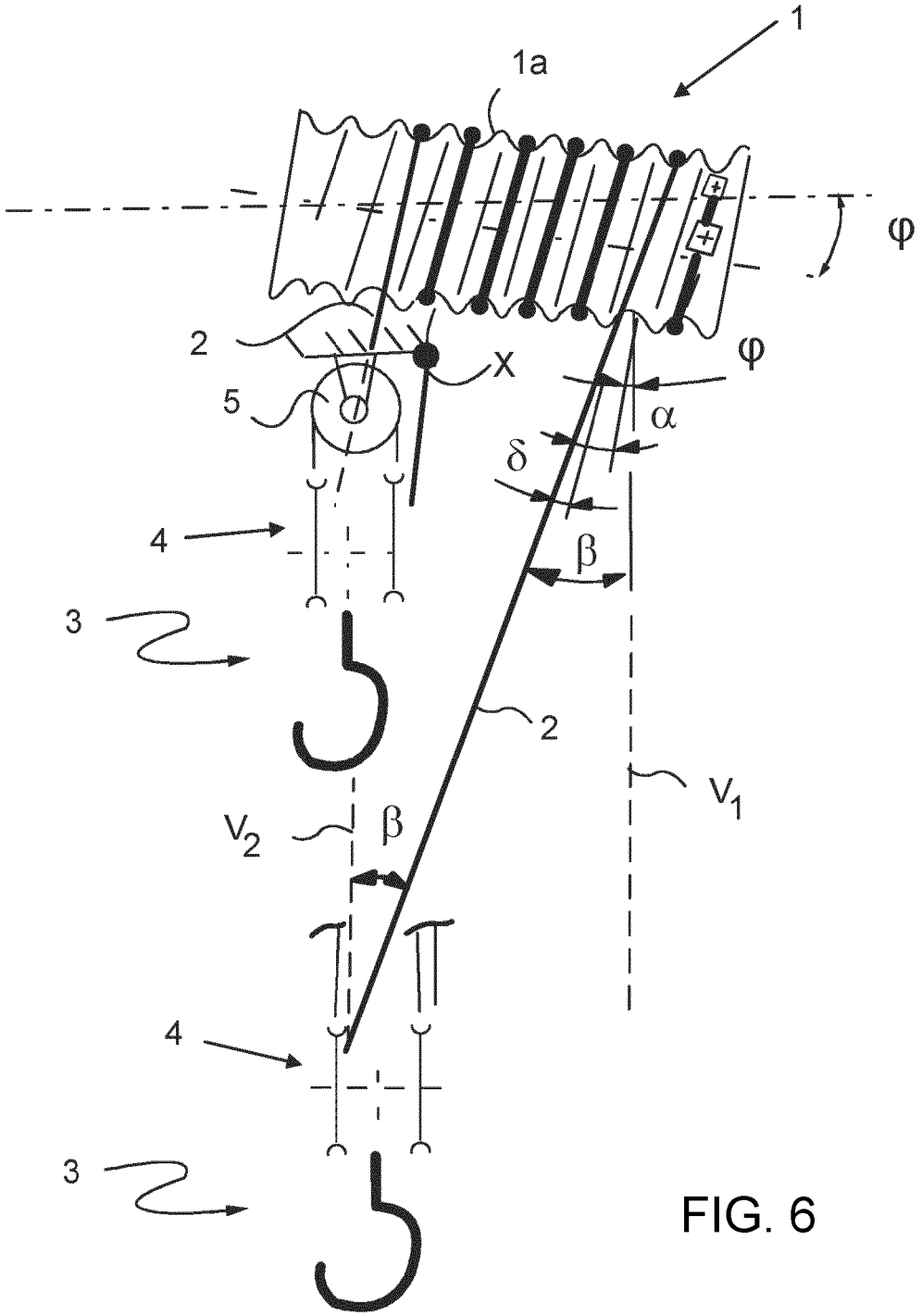

FIG. 6 presents a hoisting arrangement pursuant to the invention that contains a tilted hoisting drum 1; this differs from the hoisting arrangement in FIG. 2 in that the rope pulley arrangement 4 is rotated by 90 degrees about the vertical axis. Furthermore, hoisting rope 2 is guided onto rope drum 1 from the rope pulley that is on the side of the upper end of rope drum 1 and attachment point X for hoisting rope 2 is on the other side of sheave 5.

Figure 7:
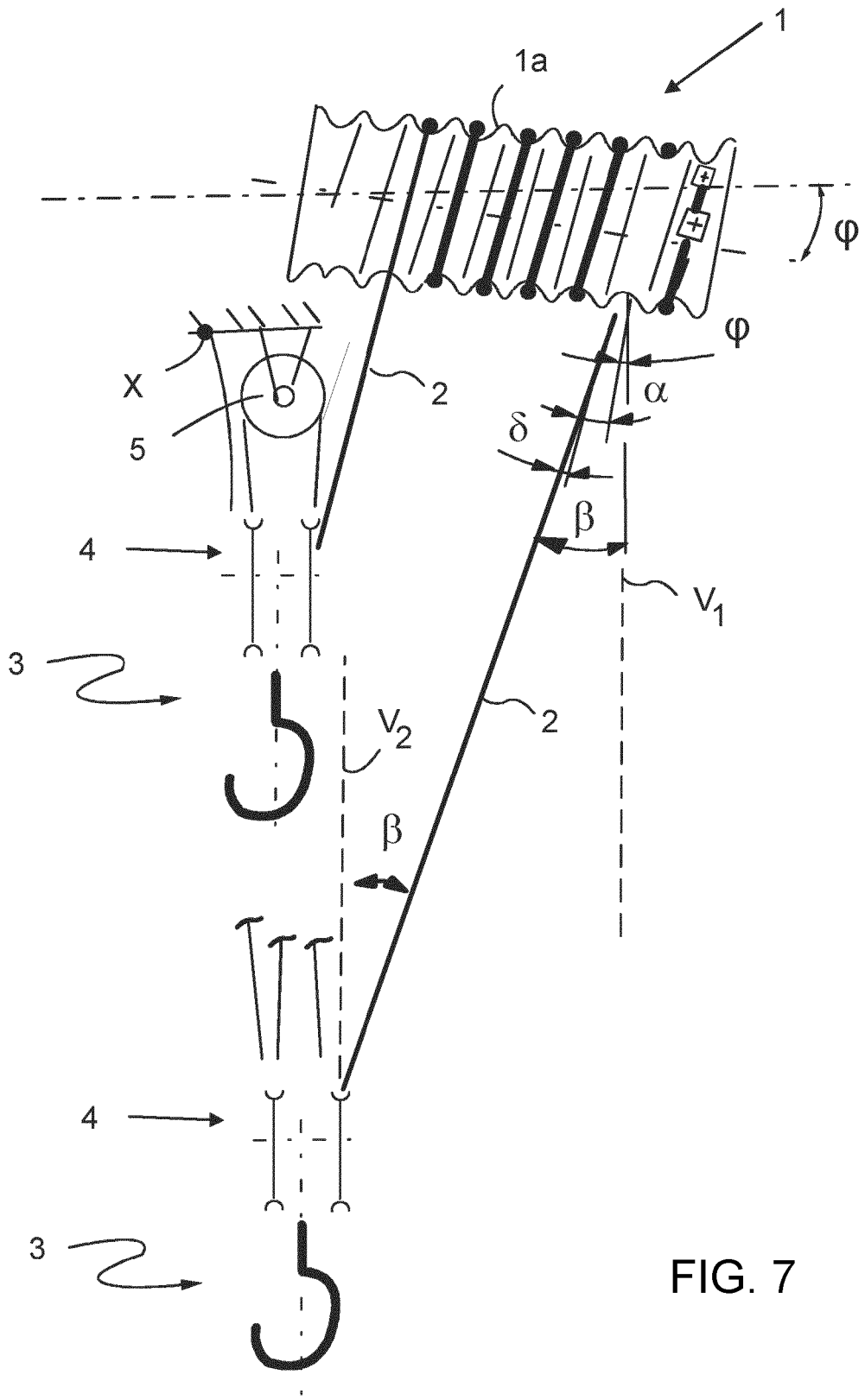

FIG. 7 presents a hoisting arrangement pursuant to the invention that contains a tilted hoisting drum 1; this differs from the hoisting arrangement in FIG. 2 in that the rope pulley arrangement 4 is rotated by 90 degrees.

FIGS. 4-7 demonstrate that the tilting of rope drum 1 pursuant to the invention may be used with differently arranged sheaves and rope pulley arrangements. Furthermore, the invention is not limited to the four ropes presented here; the number of ropes may be lower or higher depending on the hoisting height and the size of the load.

The tilting of rope drum 1 is implemented by means of at least one riser (not shown in the Figures) in the supports or bearing housings (not shown) of rope drum 1, which offers the possibility of attaching the ends of rope drum 1 at mutually different heights. This allows for utilising similar bearings at both ends of rope drum 1. A riser in a general sense refers to a device that allows for adjusting the height position. Therefore, the lower surface of a horizontal structure may be "raised" downward between at least one of the bearing housings (or supports) and the horizontal structure. Alternatively, tilting with a side-attached drum mechanism may be implemented with screw holes drilled at different heights on the attachment point or end pieces or by means of similar fastenings. Oval holes drilled at the same height are also suitable for the purpose.

Advantageously, the slanted angle of rope drum 1 is fixed in each hoisting device, but it may vary between different hoisting devices or hoisting device series.

When attachment is made at the top, a longer suspension part may be used at the drum mechanism end that will hang lower. This part may also be adjustable. The attachment point of the suspension part in the trolley or end contains a different height measurement between the ends or must be adjusted to a different height.

The present invention aims to change the basic starting point of the design; earlier, the selection of the hoisting device type involved several more or less interconnected structural parameters that defined a limited window of operation as described in the background for the invention. Expanding the window in a specific direction may have easily resulted in only one hoisting device type being available due to a specific parameter. The invention aims to completely eliminate the effects of one limiting parameter, creating a larger window of operation for each hoisting device type. Correspondingly, in serial manufacturing, the number of different parts and frame sizes may be reduced while offering even wider characteristics for each hoisting device type. For example, the building of hoisting devices with 1×8 and 1×10 roping has been limited due to this, but it is made possible by the invention.

The drawings present hoisting arrangements with an even number of ropes. An odd number of ropes (for example, 3, 5, 7 or 9 up-down pitches) is also possible, in which case the attachment point of hoisting rope 2 is adapted to hoisting member 3. This has not been separately presented in the drawings.

Therefore, the above description of the invention is only intended to illustrate the basic idea of the invention. A person skilled in the art may thus vary its details within the scope of the attached claims.

The invention claimed is:

1. A hoisting arrangement of a rope hoist, comprising:

a hoisting rope;

a rope drum, with one rope groove for the hoisting rope; and a hoisting member for hoisting a load, the hoisting member having a rope pulley arrangement for the hoisting rope, wherein the hoisting rope is routed from the rope drum at least via the rope pulley arrangement of the hoisting member to a fixed attachment point of the rope hoist, wherein the rope drum is tilted in relation to a horizontal plane in a manner where the first end of the rope drum, towards which the hoisting rope is wound in an upper position of the hoisting member, is higher than a second end of the rope drum, towards which the hoisting rope is unwound in a lower position of the hoisting member, wherein the hoisting rope is in one layer on the rope drum, and wherein a tilting angle of the drum is fixed.

2. The hoisting arrangement as claimed in claim 1, wherein the tilting angle is approximately 1-4 degrees.

3. The hoisting arrangement as claimed in claim 1, wherein the magnitude of the tilting angle depends on a length of the rope drum.

4. The hoisting arrangement as claimed in claim 1, wherein a magnitude of the tilting depends on a length of the rope drum.

5. The hoisting arrangement as claimed in claim 1, wherein the hoisting rope is guided from the rope drum via the rope pulley arrangement of the hoisting member and at least one upper sheave to the fixed attachment point of the rope hoist.

6. The hoisting arrangement as claimed in claim 1, wherein the hoisting rope contains 1× roping, in which case the hoisting rope has n up-down pitches, where n is equal to 2, 3, 4, 5, 6, 7, 8, 9 or 10.

7. The hoisting arrangement as claimed in claim 6, wherein, when the number of roping is odd (n=3, 5, 7 or 9), the attachment point of the hoisting rope is adapted to the hoisting member.

* * * * *